US005559711A

United States Patent [19]

Futamura et al.

[11] Patent Number: 5,559,711

[45] Date of Patent: *Sep. 24, 1996

[54] APPARATUS AND METHOD FOR PROCESSING EMBROIDERY DATA BASED ON ROUNDNESS OF EMBROIDERY REGION

[75] Inventors: Masao Futamura, Nagoya; Mitsuyasu Kyuno, Aichi-ken; Yukiyoshi Muto, Nagoya; Masahiro Mizuno, Kasugai, all of Japan

[73] Assignee: Brother Kogyo Kabushiki Kaisha, Aichi-ken, Japan

[ * ] Notice: The term of this patent shall not extend beyond the expiration date of Pat. No. 5,386,789.

[21] Appl. No.: 340,356

[22] Filed: Nov. 14, 1994

[30] Foreign Application Priority Data

Nov. 15, 1993 [JP] Japan ..... 5-284668

[51] Int. Cl.[6] ..... G06F 19/00; G06G 7/64; G06G 7/66

[52] U.S. Cl. ..... 364/470.09; 112/102.5; 112/470.06; 112/475.19

[58] Field of Search ..... 112/121.12, 102.5, 112/470.06, 475.19; 364/470

[56] References Cited

U.S. PATENT DOCUMENTS 5,189,623 2/1993 Komuro et al. ..... 364/470
5,386,789 2/1995 Futamura et al. ..... 112/121.12

*Primary Examiner*—Roy N. Envall, Jr.
*Assistant Examiner*—Karen D. Presley
*Attorney, Agent, or Firm*—Oliff & Berridge

[57] ABSTRACT

An apparatus for processing embroidery data to control a sewing machine to form an embroidery on a work sheet, the apparatus including a determining device for determining, based on outline data representing an outline of an embroidery region, an area of the embroidery region bounded by the outline thereof and a length of the outline of the embroidery region, and determining a degree of roundness of the embroidery region based on the determined area and length, and a selecting device for selecting, based on the determined degree of roundness of the embroidery region, one of a plurality of different stitching manners in which the embroidery is to be formed in the embroidery region by the sewing machine according to the embroidery data.

24 Claims, 6 Drawing Sheets

APPARATUS AND METHOD FOR PROCESSING EMBROIDERY DATA BASED ON ROUNDNESS OF EMBROIDERY REGION

BACKGROUND OF THE INVENTION

1. Field of the Invention

The present invention relates to an apparatus for processing embroidery data to control a sewing machine to form an embroidery on a work sheet.

2. Related Art Statement

There is known an embroidery sewing machine which automatically forms an embroidery on a work sheet such as a work cloth. Embroidery data are used to control the sewing machine to automatically form the embroidery on the work sheet. The embroidery data may include sets of stitch-position data representing stitch positions located on the outline of an outline-bounded area to be filled with stitches to provide the embroidery. In this case, each stitch position may be defined by respective amounts of movement of the work sheet relative to the sewing needle in the X and Y directions pre-determined for the sewing machine. Otherwise, the embroidery data may include sets of block data representing respective outlines of polygonal blocks as divided parts of an outline-bounded area, and stitch-density data representing a stitch density, e.g., number of stitches to be formed in each polygonal block. U.S. Pat. No. 5,189,623 assigned to the Assignee of the present application discloses an embroidery data processing apparatus which automatically produces such embroidery data.

U.S. patent application Ser. No. 08/254,790 assigned to the Assignee of the present application discloses another embroidery data processing apparatus which may be constituted by a personal computer (PC) and an image scanner connected to the PC. The disclosed apparatus processes embroidery data based on an original image in the following manner:

First, the image scanner is operated to read in or pick up an original image from an original (e.g., color image painted or printed on a white base sheet), so that the PC produces image data representing the original image. Next, the PC divides, based on the image data, the original image into one or more outline-bounded areas each of which is independent of the other areas. For example, regarding cherries, A, shown in FIG. 4, the disclosed apparatus divides the original image A into three outline-bounded areas, i.e., stem, B, in, e.g., blue color, first cherry, C, in, e.g., yellow color, and second cherry, D, in, e.g., red color, as shown in FIGS. 5(*a*), 5(*b*), and 5(*c*), respectively. Then, the PC produces sets of outline data representing respective outlines of the embroidery areas B, C, D, according to a known outline determining algorithm, and finally produces embroidery data based on the thus obtained outline data. The PC may produce, as the embroidery data, sets of block data representing the respective outlines of polygonal blocks such as quadrangles and/or triangles, e.g., X and Y coordinates of the positions of the vertices of the quadrangular or triangular blocks. Alternatively, the PC may produce, as the embroidery data, sets of stitch-position data representing stitch positions located on the outline of each of the polygonal blocks where, e.g., satin stitches or seed stitches are formed to fill the inside area of each block.

Meanwhile, there are known various stitching manners that may be employed to fill an embroidery area, i.e., produce an embroider in the embroidery area; for example, satin stitching shown in FIG. 7(*a*), seed stitching shown in FIG. 7(*b*), and zigzag stitching shown in FIG. 7(*c*). The satin stitching is characterized by connecting the two opposed portions of an outline, R, of an embroidery area, with a "single" stitch, s1, i.e., without any needle's penetration of the work sheet inside the outline R. The stitch density for the satin stitching may be defined by a number of the single stitches s1 to be formed in unit length in an embroidering direction indicated at arrow in FIG. 7(*a*). The embroidering direction may be parallel to a straight line connecting a stitch-start position, S, and a stitch-end position, E, on the outline R. The start and end positions S, E may be determined as the two positions that are the most distant from each other on the outline R.

The seed stitching is characterized by connecting the two opposed portions of an outline, R, of an embroidery area, with a series of "unit" stitches, s2, i.e., with needle's penetrations of the work sheet at regular intervals of distances inside the outline R. The stitch density for the seed stitching may be defined by a number of "stitch lines" to be formed in unit length in an embroidering direction indicated at arrow in FIG. 7(*b*). Each stitch line consists of a series of unit stitches s2 connecting the two opposed portions of the outline R. The embroidering direction, and start and end positions S, E, for the seed stitching may be determined in the same manners as those for the satin stitching.

The zigzag stitching is characterized by forming, along a reference line, a number of stitches, s3, having a constant width. The stitch density for the zigzag stitching may be defined by a number of the stitches to be formed in unit length along the reference line.

In the event that two identical embroidery areas are embroidered by two different stitching manners, respectively, the two embroideries produced may give different impressions regarding the quality of conformance or finishing. Therefore, it is necessary for a user to specify a stitching manner suitable for each embroidery area. However, in the prior apparatus, only a single sort of stitching manner is employed to embroider all embroidery areas. Otherwise, in a different prior apparatus, a user is required to select one of different stitching manners to embroider each of various embroidery areas.

However, in the case where only the satin stitching, for example, is used to embroider various embroidery areas having different shapes, this manner may not be suitable for elongate embroidery areas for which the zigzag stitching is more suitable, and not suitable for large areas for which the seed stitching is more suitable. In addition, in the case where a user is required to select one of different stitching manners for embroidering each of various embroidery areas, it is cumbersome and time-consuming to accomplish the task, increasing the burden on the user. In the last case, the user may not be able to select a suitable stitching manner for each embroidery area so long as he or she is not familiar with the task.

SUMMARY OF THE INVENTION

It is therefore an object of the present invention to provide an apparatus and a process for determining a stitching manner to embroider an embroidery area, without requiring a user to specify the stitching manner, such that the determined stitching manner is suitable for the specific shape of the embroidery area, and processing embroidery data in accordance with the thus determined stitching manner.

The above object has been achieved by the present invention. According to a first aspect of the present invention, there is provided an apparatus for processing embroidery data to control a sewing machine to form an embroidery on a work sheet, the apparatus comprising determining means for determining, based on outline data representing an outline of an embroidery region, an area of the embroidery region bounded by the outline thereof and a length of the outline of the embroidery region, and determining a degree of roundness of the embroidery region based on the determined area and length, and selecting means for selecting, based on the determined degree of roundness of the embroidery region, one of a plurality of different stitching manners in which the embroidery is to be formed in the embroidery region by the sewing machine according to the embroidery data.

In the embroidery data processing apparatus in accordance with the first aspect of the invention, the determining means determines, based on outline data representing an outline of an embroidery region, an area and an outline length of the embroidery region, and determines a degree of roundness of the embroidery region based on the determined area and outline length. The thus determined degree of roundness indicates whether the embroidery region is round or otherwise elongate. The selecting means selects, based on the determined degree of roundness of the embroidery region, one of a plurality of different stitching manners, so that in the thus selected stitching manner the embroidery is formed in the embroidery region by the sewing machine according to the embroidery data processed by the present apparatus. The present apparatus determines a stitching manner suitable for the specific shape of an embroidery region, large or small and/or round or elongate.

According to a preferred feature in accordance with the first aspect of the invention, the embroidery data processing apparatus further comprises producing means for producing the embroidery data based on the outline data and stitching-manner data representing the one stitching manner selected by the selecting means. The producing means may comprise means for producing, as the embroidery data, at least one of (a) a number of sets of stitch-position data representing stitch positions on the outline of the embroidery region where a sewing needle Of the sewing machine penetrates the work sheet and (b) a plurality of sets of block data each of which represents an outline of a corresponding one of a plurality of polygonal blocks which cooperate with each other to define the embroidery region. Otherwise, the producing means may comprise means for producing the embroidery data comprising the outline data associated with said stitching-manner data. In either case, the embroidery data may be recorded on an external memory such as a floppy disk or a flash-memory card.

According to another feature of the first aspect of the invention, the determining means comprises means for determining, as the degree of roundness of the embroidery region, at least one of a first parameter, K, defined by a following first expression (1) and a second parameter, K', defined by a following second expression (2):

$$K=S/L^2 \quad (1)$$

$$K=S/L \quad (2)$$

where

S is the determined area of the embroidery region, and

L is the determined length of the outline of the embroidery region.

The employment of the second parameter K' is advantageous in dealing with an quantization error which may be contained in the determined outline length of the embroidery region, in particular where the embroidery region is stall. Based on both of the first and second parameters K, K', the present apparatus more reliably determines a stitching manner suitable for the specific shape of each embroidery region. In this case, the selecting means may comprise means for selecting the one stitching manner from the plurality of different stitching manners, by comparing the at least one of the first and second parameters K, K' with at least one of a first reference value and a second reference value, respectively.

According to yet another feature of the first aspect of the invention, the apparatus further comprises an image pick-up device which picks up, as the embroidery region, an original image from an original, and produces the outline data comprising image data representing the original image. In this case, the image pick-up device may comprise means for producing, as the image data, a number of sets of picture-element data each set of which represents a corresponding one of a number of picture elements of the original image, the determining means determining the area of the embroidery region based on the set is of picture-element data representing the picture elements contained in the original image as the embroidery region, and determining the length of the outline of the embroidery region based on the sets of picture-element data representing the picture elements defining an outline of the original image as the embroidery region.

According to a second aspect of the present invention, there is provided a method of processing embroidery data to control a sewing machine to form an embroidery on a work sheet, the process comprising the steps of (A) determining, based on outline data representing an outline of an embroidery region, an area of the embroidery region bounded by the outline thereof and a length of the outline of the embroidery region, and determining a degree of roundness of the embroidery region based on the determined area and length, and (B) selecting, based on the determined degree of roundness of the embroidery region, one of a plurality of different stitching manners in which the embroidery is to be formed in the embroidery region by the sewing machine according to the embroidery data.

The embroidery data processing process in accordance with the second aspect of the invention, the embroidery is formed in the embroidery region on the work sheet with high quality of conformance or finishing.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings in which:

FIG. 5(*b*) is a view of a first cherry, C, of the cherries A of FIG. 4;

FIG. 5(*c*) is a view of a second cherry, D, of the cherries A of FIG. 4;

FIG. 7(*b*) is a view for explaining seed stitching;

FIG. 7(*c*) is a view for explaining zigzag stitching; and

DETAILED DESCRIPTION OF THE PREFERRED EMBODIMENTS

There will be described an embroidery data processing apparatus 1 embodying the present invention, by reference to FIGS. 1 through 7. The following description relates to the operation of the apparatus 1 for processing embroidery data to embroider cherries, A, as an original color image, shown in FIG. 4, wherein the cherries A include a stem, B, a first cherry, C, and a second cherry, D. The original image A, i.e., original is obtained by painting or printing the stem B in blue color, the first cherry C in yellow color, and the second cherry D in red color, on a white base sheet. The three independent embroidery regions B, C, D are indicated at different hatchings, respectively, in FIG. 4 and FIGS. 5(*a*), 5(*b*), 5(*c*).

Figure 1:
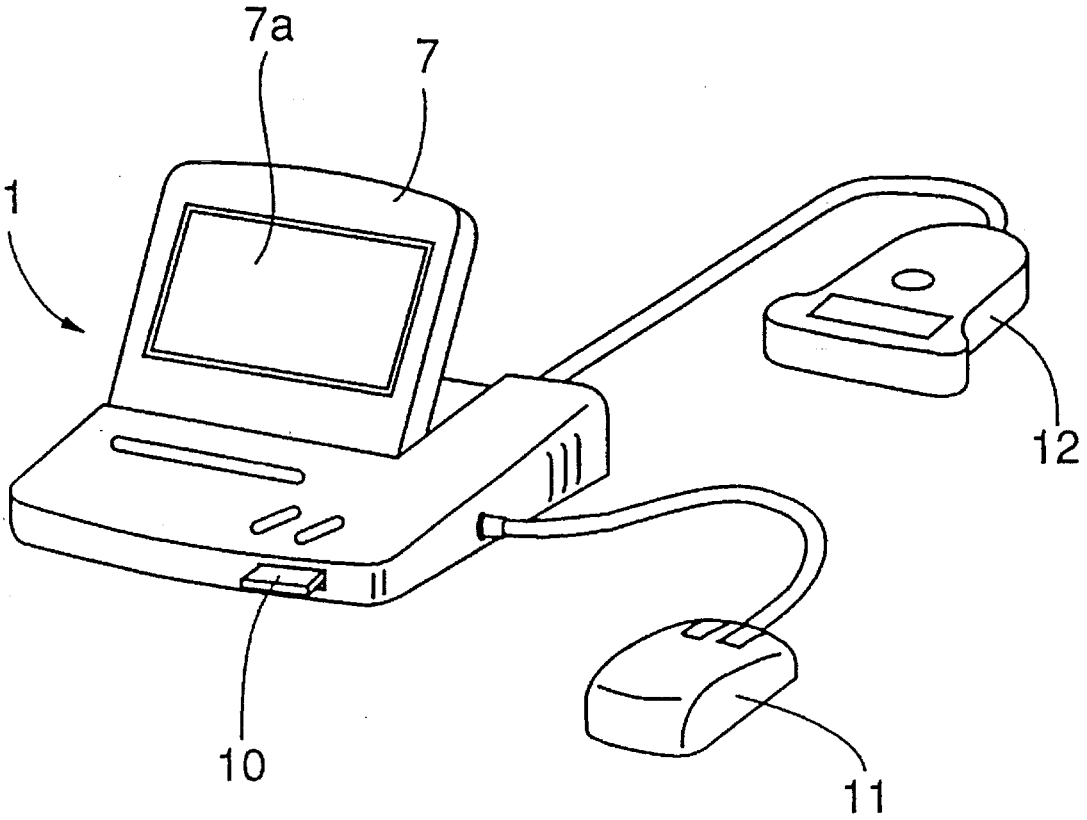
FIG. 1 is a perspective view of an embroidery data producing apparatus embodying the present invention.
Figure 8:
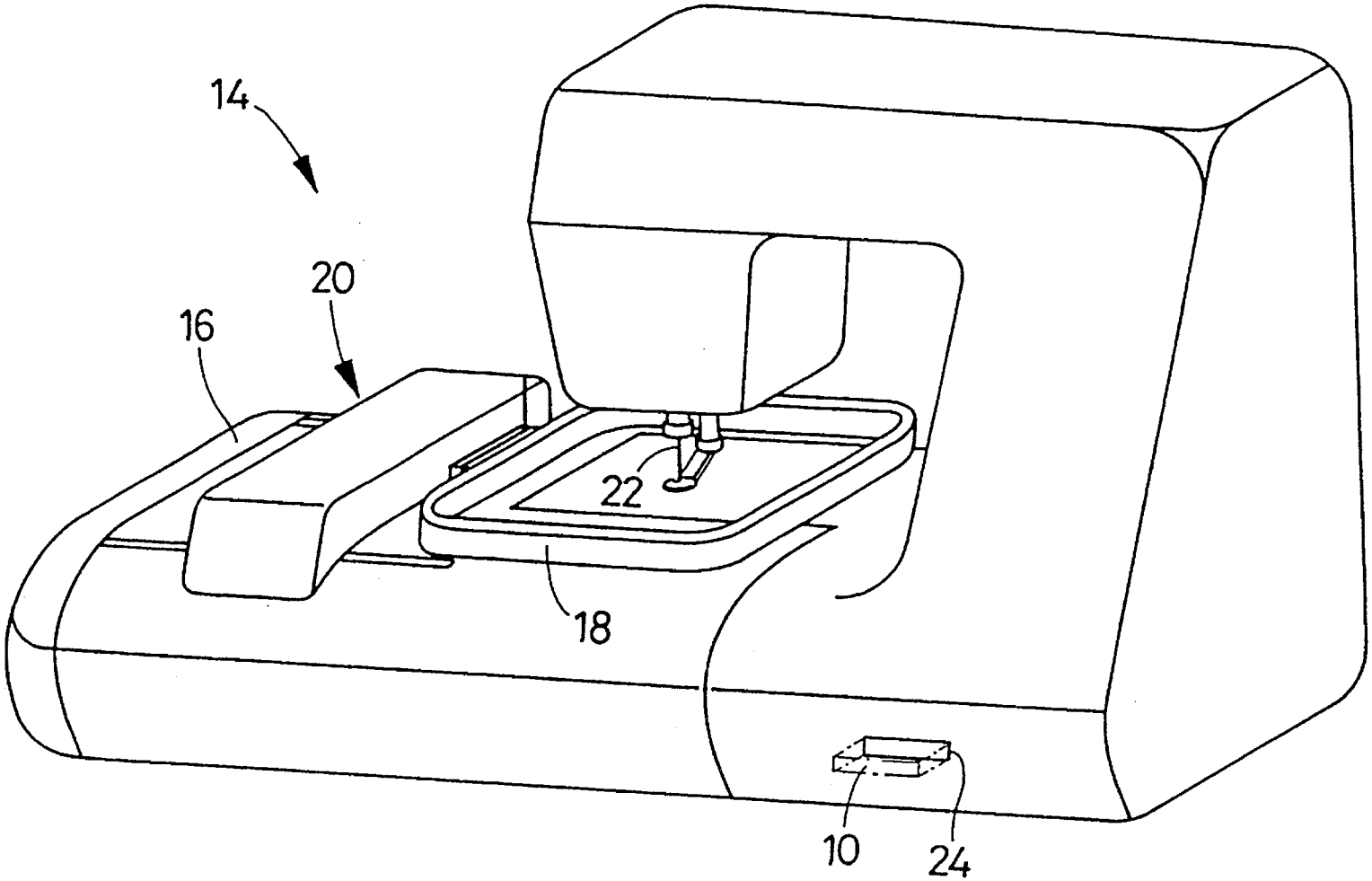
FIG. 8 is a view of a home sewing machine which automatically forms an embroidery on a work cloth using embroidery data processed by the apparatus of FIG. 1.

FIG. 8 shows a domestic or home embroidery sewing machine 14 which automatically embroiders the original image A, i.e., produces a color embroidery A on a work sheet, W, (FIG. 6) such as a cloth, fabric, or leather, according to the embroidery data processed by the apparatus of FIG. 1. The sewing machine 14 includes a machine bed 16; an embroidery frame 18 which supports the work sheet W; an X-Y feed mechanism 20 which displaces the embroidery frame 18 to an arbitrary position in a horizontal plane defined by an X-Y coordinate system pre-determined for the sewing machine 14; a sewing needle which conveys a color embroidery thread (not shown); a loop catcher (not shown) provided under the machine bed 16 for catching a loop of the embroidery thread conveyed by the sewing needle 22; a drive mechanism (not shown) which reciprocates the sewing needle 22 and rotates the loop catcher in synchronism with each other; and a control device (not shown) which may be provided by a microcomputer and which operates for controlling the feed and drive mechanism to automatically form the color embroidery A on the work sheet W according to the embroidery data processed by the apparatus 1 of FIG. 1.

Figure 6:
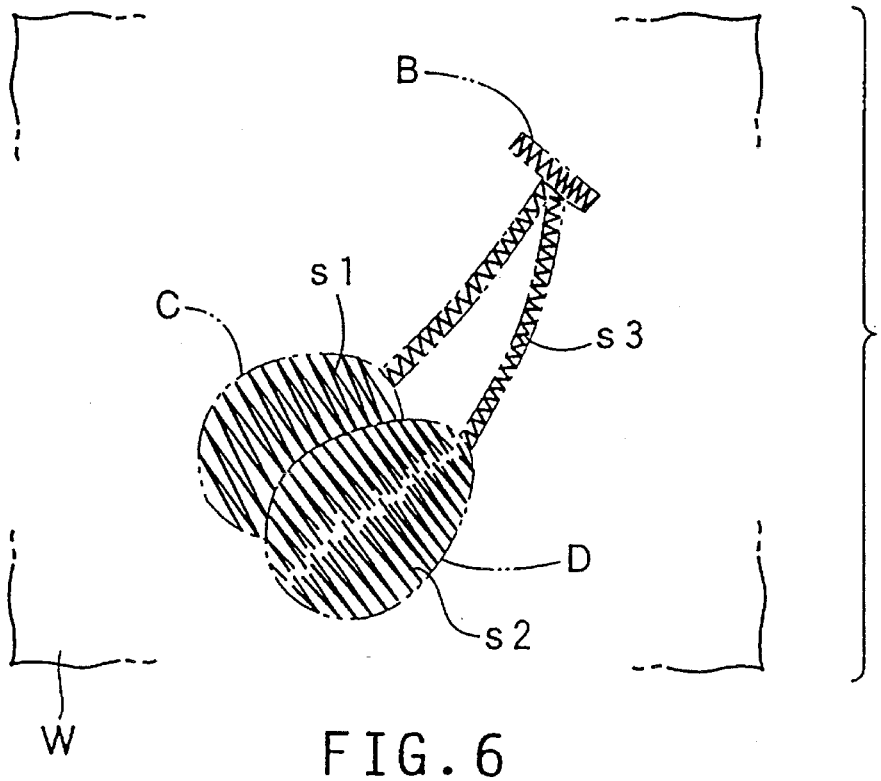
FIG. 6 is a view of an embroidery of the cherries A formed on a work cloth, W, using the embroidery data processed by the apparatus of FIG. 1.

The embroidery data processed by the apparatus 1 of FIG. 1 include sets of stitch-position data (e.g., X and Y coordinate data) which represent respective stitch positions where the sewing needle 22 penetrates the work sheet W to form corresponding stitches s1, s2, s3 (FIG. 6). In this case, each set of stitch-position data represents respective amounts of movement of the work sheet W or embroidery frame 18 along the X and Y axes to form a corresponding stitch. Alternatively, embroidery data may include sets of block data each of which represents the outline of a corresponding one of polygonal blocks which cooperate with each other to define an original image extending in an embroidering direction. In the latter case, the control device of the sewing machine 14 may be programmed to produce sets of stitch-position data based on the sets of block data and a set of stitch-density data representing a number of stitches to be formed either in each block or in unit length in the embroidering direction.

As shown in FIG. 8, the sewing machine 14 has a data reading device 24 which reads embroidery data from a flash-memory card 10 (flash memory is an EEPROM (electrically erasable and programmable read only memory)). The present apparatus 1 processes embroidery data and records the processed embroidery data in the flash-memory card 10, as described later. Alternatively, the apparatus 1 may directly be connected to the sewing machine 14, so that the embroidery data processed by the apparatus 1 may directly be transferred to the control device of the sewing machine 14. Otherwise, the apparatus 1 itself may be incorporated into the sewing machine 14 of FIG. 8.

Figure 2:
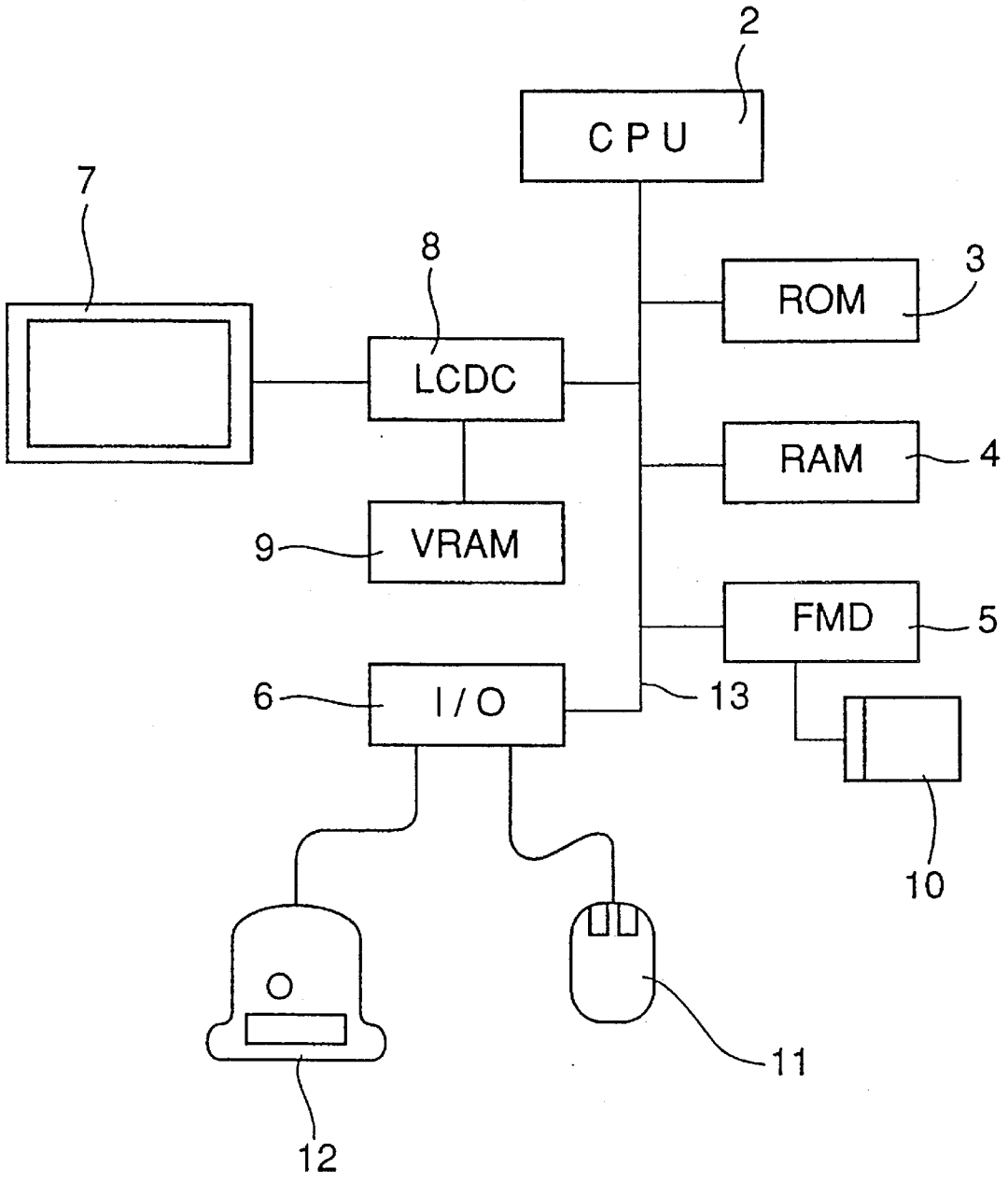
FIG. 2 is a diagrammatic view of the electric arrangement of the apparatus of FIG. 1.

Next, the arrangement of the embroidery data processing apparatus 1 will be described in detail by reference to FIGS. 1 and 2. The apparatus 1 is essentially constituted by a microcomputer including a central processing unit (CPU) 2, a read only memory (ROM) 3, a random access memory (RAM) 4, a flash-memory device (FMD) 5, and an input and output (I/O) interface 6 which are connected to one another via bus 13. The FMD 5 holds the flash-memory card 10 as an external memory. The flash-memory card 10 can be removed from the FMD 5 of the apparatus of FIG. 1 so as to be inserted into the data reading device 24 of the sewing machine 14.

The present apparatus 1 additionally includes, on the top thereof, a liquid crystal display (LCD) 7 having a screen 7*a* for providing a color representation of the original image A taken from the original. The LCD 7 is controlled by a display control device (LCDC) 8. A display-data memory device in the form of a video RAM 9 is connected to the LCDC 8. Additionally, the apparatus 1 includes a mouse 11 which is operable by an operator or user for moving a cursor (not shown) on the screen 7*a* of the LCD display 7; and a color image scanner 12 for picking up the original color image A from the original. The mouse 11 and image scanner 12 are connected to the microcomputer via the I/O interface 6.

In the present embodiment, the image scanner 12 is hand-operable for taking a chromatic color image. With the upper portion of the scanner 12 being held by the palm of the user, the lower portion (i.e., reading head) of the scanner 12 is rolled over the original. With a button (not shown) of the scanner 12 being pushed by the user, the scanner 12 is forced by the user to move slowly in one direction over the original image A. Consequently the original image A is obtained as raster-type digital image data, i.e., sets of picture-element data corresponding to a number of picture elements of the original image A. Each set of picture-element data is constituted by a set of eight-bit hue data representing a value from 0 to 255 corresponding to a hue of a picture element. Thus, the image scanner 12 serves as an image pick-up device which picks up an original image from an original, and produces image data representing the original image. The thus obtained image data are temporarily stored in the RAM 4. In the present embodiment, the resolution of the image scanner 12 is 100 dpi (dot per inch).

The embroidery data processing apparatus 1 is programmed to automatically process embroidery data based on the original image A. For processing the embroidery data, first, the image scanner 12 is operated to read as image data the color image A from the original, subsequently divides the color image A into one or more independent single-color regions having different colors from each other, determines the outline of each single-color region, and then produces a batch of embroidery data for each single-color region, based on the determined outline of the same.

As described in detail later, the present apparatus 1 measures the area and outline length of each single-color region, calculates a degree of roundness of each single-color region based on the measured area and outline length of the same, and selects a stitching manner suitable for each single-color region based on the calculated roundness degree. Subsequently, the apparatus 1 produces embroidery data for each single-color region according to the selected stitching manner. In the present embodiment, the CPU 2, ROM 3, and RAM 4 serve as determining means for determining, based on outline data representing an outline of an embroidery region, an area of the embroidery region bounded by the outline thereof and a length of the outline of the embroidery region, and determining a degree of roundness of the embroidery region based on the determined area and length, and also serve as selecting means for selecting, based on the determined degree of roundness of the embroidery region, one of different stitching manners, so that in the determined stitching manner the embroidery is formed in the embroidery region by the sewing machine 14 according to the embroidery data processed by the apparatus 1.

Figure 3:
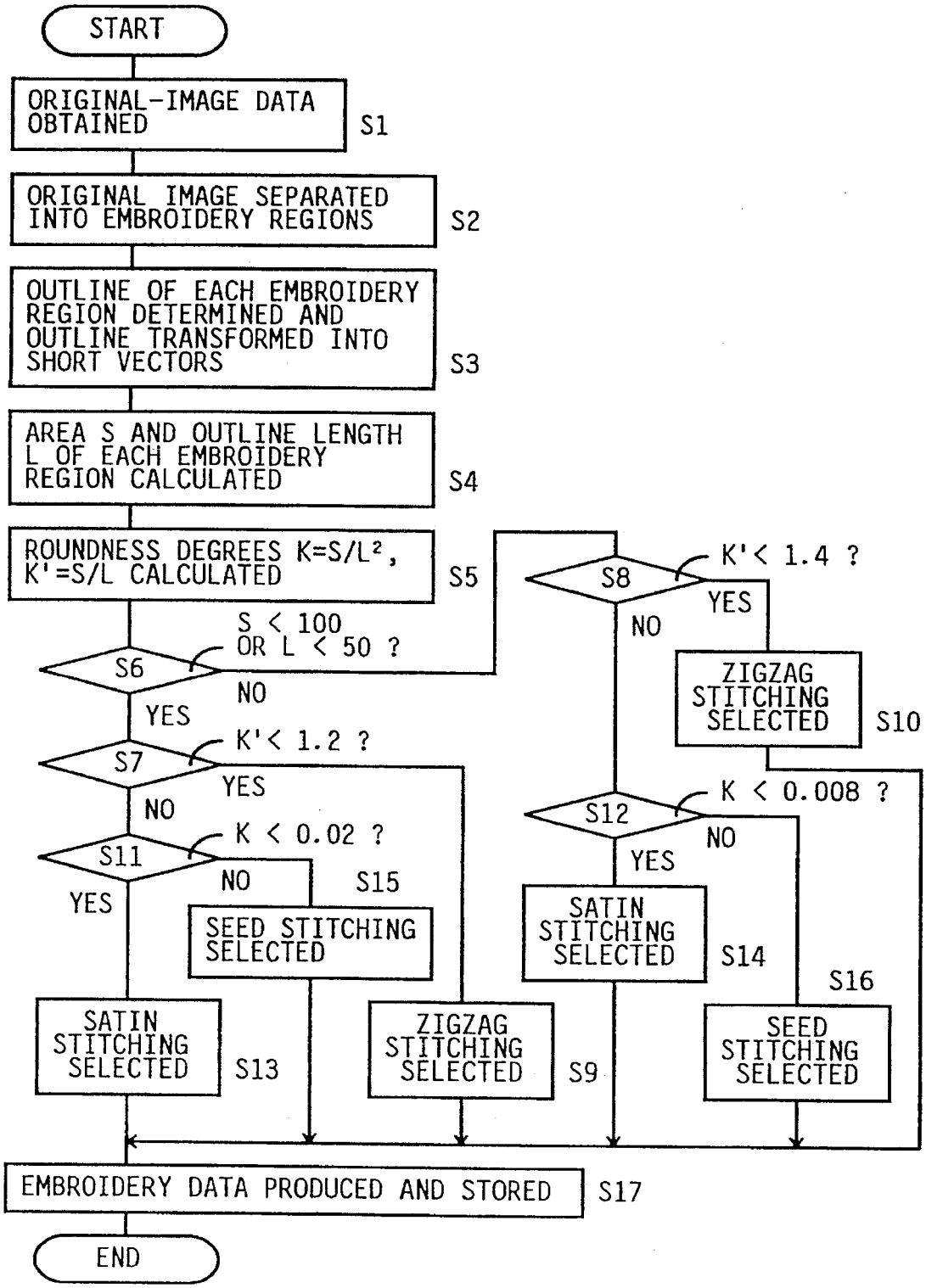
FIG. 3 is a flow chart representing the control program according to which the apparatus of FIG. 1 operates for processing embroidery data.

There will be described the operation of the embroidery data processing apparatus 1, by reference to the flow chart of FIG. 3 which represents the control program according to which the apparatus 1 operates for processing embroidery data based on an original image. The following description relates to the operation of the apparatus 1 for processing embroidery data for the original image A shown in FIG. 4.

First, at Step S1, the image scanner 12 is operated to pick up the color image A from the original, so that the CPU 2 operates for producing image data representing the original color image A. As described previously, the color image A includes a plurality of single-color regions having different colors, respectively. The image data include a number of sets of eight-bit hue data each set of which represents the hue of a corresponding one of the picture elements of the color image A taken by the image scanner 12. Based on the image data, the CPU 2 co,hands the LCDC 8 to display the color image A on the screen 7*a* of the LCD 7.

Figure 4:
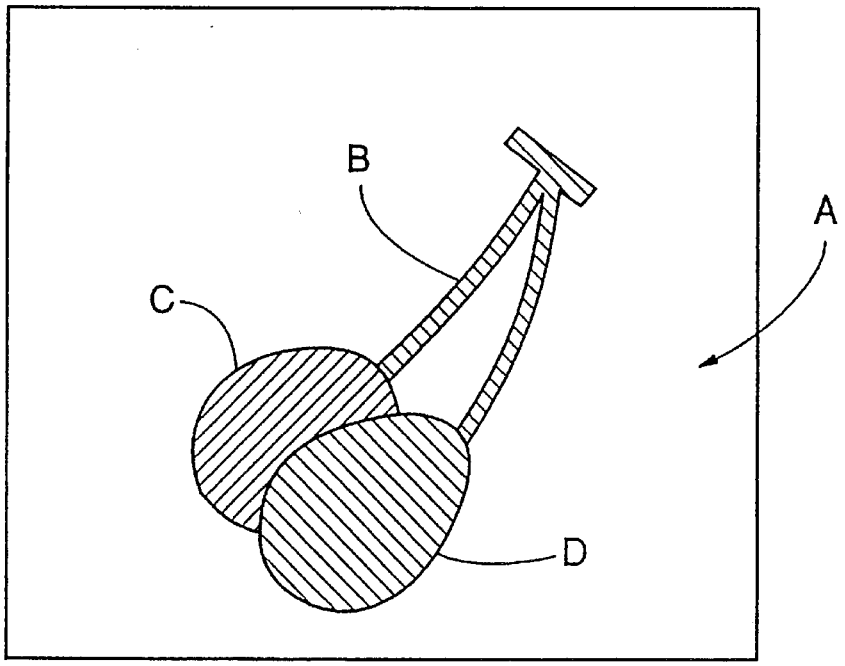
FIG. 4 is a view of cherries, A, as an example of an original image based on which the apparatus of FIG. 1 processes embroidery data.
Figures 5A, 5B, 5C:
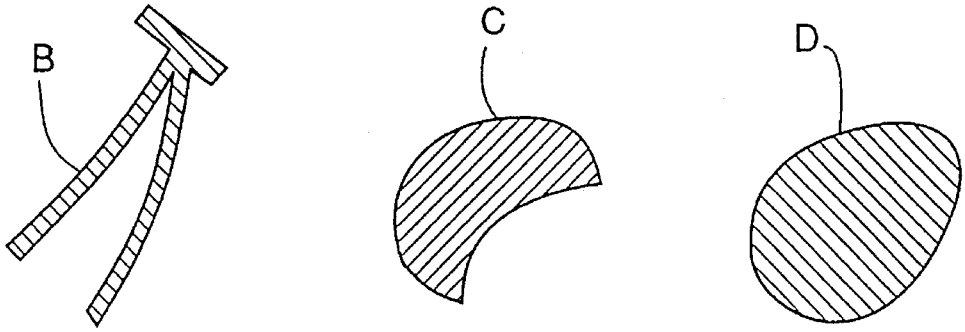
FIG. 5(*a*) is a view of a stem, B, of the cherries A of FIG. 4.

Subsequently, at Step S2, the CPU 2 operates for dividing, based on the image data, the color image A into one or more single-color regions having different colors. This dividing operation is described in detail in the previously-mentioned U.S. patent application Ser. No. 08/254,790. Each single-color region may be identified by determining the outline thereof according to an outline determining algorithm known in the art of processing picture-element data or bit data. Alternatively, each single-color region may be identified according to a known contiguous-picture-element labelling algorithm. Thus, the original color image A of FIG. 4 is divided into three independent single-color regions, i.e., stem B, first cherry C, and second cherry D. The CPU 2 operates for producing three sets of color-region data representing the three single-color regions B, C, D and temporarily stores them in the RAM 4.

Subsequently, at Step S3, the CPU 2 operates for extracting the outline of each of the single-color regions B, C, D, thereby producing three sets of outline data each of which represents the outline of a corresponding one of the three single-color regions. Additionally, the CPU transforms, based on the sets of outline data, the outline of each single-color region B, C, D into a series of short vectors each having an appropriate length. The extraction of the outline from each single-color region B, C, D may be omitted in the case where at Step S2 each single-color region is identified by determining the outline of the same according to the known outline determining algorithm. Meanwhile, in the case where at Step S2 each single-color region is identified according to the known contiguous- picture-element labelling algorithm, the outline of each single-color region is determined, at Step S3, according to the known outline determining algorithm. The transformation of an outline into a series of short vectors may be carried out by locating a series of defining points at regular intervals of distance on the outline. In the last case, the length of each short vector is equal to the regular interval of distance between a pair of adjacent defining points located on the outline.

Step S3 is followed by Step S4 to measure a surface area, S, and an outline length, L, of each single-color region B, C, D. In the present embodiment, the area S of each single-color region is calculated by counting the number of contiguous picture elements contained in the region. The outline length L of each single-color region is obtained as a "chain" length which is in almost cases equal to the number of contiguous picture elements defining the outline of the region. However, in some rare cases, the chain length is not equal to the above-defined number. For example, in the case where an elongate embroidery region consists of five picture elements which are Contiguous with each other in an array, the chain length of the outline of the elongate region is counted as not five but eight according to one of known counting methods. Starting with the picture element at one end, the second element adjacent to the first, end element is counted as one, the third or middle element is counted as two, . . . , and the fifth element at the other end is counted as four, and coming backing from the fifth element, the fourth element adjacent to the fifth element is counted as five, . . . , and the first element is counted as eight. Thus, the chain length of the outline of the elongate region is measured as eight. This is different from the actual length, five, of the outline of this region, and this difference is a quantization error that is caused by dealing with picture-element data or bit data. This elongate region may represent a straight or curved line along which linear stitches are to be formed in a running stitching known as one of embroidery stitching manners.

Subsequently, at Step S5, the CPU 2 calculates a roundness degree of each single-color region B, C, D, based on the calculated area S and outline length L of the region. The roundness degree is the degree of similarity of an embroidery region to a circular region (i.e., degree of dissimilarity of an embroidery region from an elongate region). In the present embodiment, the CPU 2 determines two sorts of roundness degrees, i.e., first and second roundness parameters K and K' according to the following expressions (1) and (2), respectively:

$$K=S/L^2 \quad (1)$$

$$K'=S/L \quad (2)$$

The second roundness parameter K' is particularly effective in dealing with a small embroidery region wherein the area S and outline length L of the region, each determined by counting the number of contiguous picture elements, may contain a quantization error (for example, the "chain" length of an oblique line as part of the outline of a small region tends to be counted as being greater than that of a vertical or horizontal line whose actual length is equal to that of the oblique line).

Figures 7A, 7B, 7C:
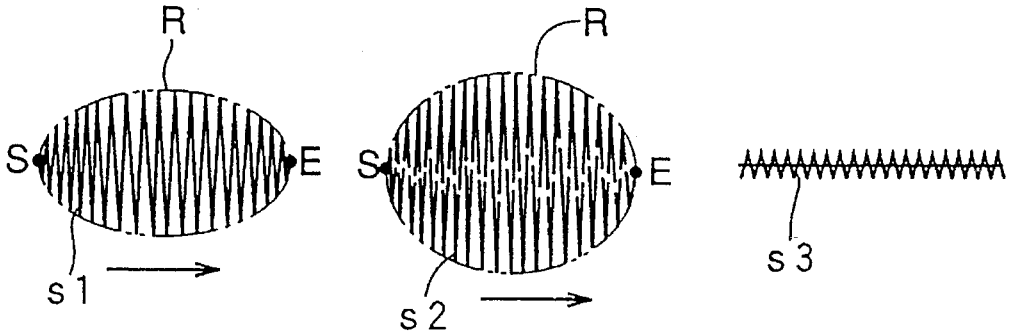
FIG. 7(*a*) is a view for explaining satin stitching.

Step S5 is followed by Step S6 and the following steps to select, from the three stitching manners, i.e., satin stitching, seed stitching and zigzag stitching shown in FIGS. 7(*a*) to 7(*c*), a stitching manner suitable for each single-color region B, C, D. The three stitching manners have the previously-described characteristics, respectively. The satin stitching is suitable for an embroidery region having a large area S. The seed stitching is suitable for an embroidery region having a large area S and a great length L, i.e. , having a high degree of roundness. The zigzag stitching is suitable for an elongate embroidery region.

At Step S6, the CPU 2 judges whether each single-color region B, C, D is large or small. If the area S of each single-color region is smaller than 100, or if the outline length L of each single-color region is smaller than 50, a positive judgment is made at Step S6. If the area S of each single-color region is not smaller than 100, and simultaneously if the outline length L of each single-color region is not smaller than 50, a negative judgment is made at Step S6. In the present embodiment, different threshold values for each roundness parameter K, K' are employed for large and small embroidery regions, respectively. Thus, the technique of selection of a suitable stitching manner for an embroidery region is improved.

If a positive judgment is made at Step S6, i.e., if each single-color region B, C, D is small, the control of the CPU 2 proceeds to Step S7 to judge whether the second roundness parameter K' is smaller than a first threshold value, e.g., 1.2. On the other hand, if a negative judgment is made at Step S6, i.e., if each single-color region B, C, D is large, the control of the CPU 2 proceeds with Step S8 to judge whether the second roundness parameter K' is smaller than a second threshold value, e.g., 1.4. If the second roundness parameter K' is smaller than the first or second threshold value and therefore a positive judgment is made at Step S7 or Step S8, the CPU 2 assumes that the single-color region in question is an elongate embroidery region. Thus, the control of the CPU 2 goes to Step S9 or Step S10 to select the zigzag stitching for the single-color region or area.

On the other hand, if the second roundness parameter K' is not smaller than the first or second threshold value and therefore a negative judgment is made at Step S7 or Step S8, then the control of the CPU 2 goes to Step S11 to judge whether the first roundness parameter K is smaller than a third threshold value, e.g., 0.02 for small embroidery regions, or to Step S12 to judge whether the first roundness parameter K is smaller than a fourth threshold value, e.g., 0.008 for large embroidery regions, respectively. If the first roundness parameter K is smaller than the third or fourth threshold value and therefore a positive judgment is made at Step S11 or Step S12, the CPU 2 assumes that the single-color region in question is a somewhat elongate region. Thus, the control of the CPU 2 goes to Step S13 or Step S14 to select the satin stitching for the single-color region. On the other hand, if the first roundness parameter or index K is not smaller than the third or fourth threshold value and therefore a negative judgment is made at Step S11 or Step S12, the CPU 2 assumes that the single-color region in question has a high similarity to a circular region. Thus, the control of the CPU 2 goes to Step S15 or Step S16 to select the seed stitching for the single-color region.

After a suitable stitching manner has been selected for each single-color regions B, C, D at Step S9, S10, S13, S14, S15, or S16, the control of the CPU 2 goes to Step S17 to divide each single-color region into a plurality of polygonal blocks such as quadrangles and/or triangles and produce, as first-step embroidery data, sets of block data representing the outlines of the polygonal blocks. Furthermore, based on the sets of block data, the CPU 2 produces, as second-step embroidery data, sets of stitch-position data to control the sewing machine 14 to form, on the work sheet W, the embroidery A by sequentially filling the respective polygonal blocks of each single-color region B, C, D, with the satin, seed, or zigzag stitches formed with a corresponding color thread. Additionally, at Step S17, the CPU 2 stores the thus produced embroidery data (block data or stitch-position data) in the flash-memory card 10. The flash memory 10 can be removed from the embroidery data processing apparatus 1, and inserted into the data reading device 24 of the sewing machine 14. According to the embroidery data stored in the flash memory 10, the sewing machine 14 automatically forms the embroider A in multiple colors using, e.g., three color-different embroidery threads.

FIG. 6 shows the embroidery A formed on the work sheet W by the sewing machine 14 according to the embroidery data processed by the apparatus of FIG. 1 and stored in the flash-memory card 10. Specifically, the stem B is embroidered with the zigzag stitches s3 using a blue thread; the first cherry C is embroidered with the satin stitches s1 using a yellow thread; and the second cherry D is embroidered with the seed stitches s2 using a red thread. Thus, the present apparatus 1 automatically selects a stitching manner suitable for the shape of each embroidery region, so that an excellent embroidery having a good conformance and finishing is produced on the cloth W.

It emerges from the foregoing description that, in the present embodiment, the CPU 2 calculates, based on the area S and outline length L of each embroidery region, a roundness parameter K, K' indicating whether the embroidery region has a similarity to a round region or an elongate one, and automatically selects, from a plurality of stitching manners, a stitching manner suitable for the shape of the embroidery region, based on the calculated roundness degree K, K'. Thus, the present apparatus 1 is more versatile than the previously-identified first prior apparatus wherein only a single stitching manner is employed to embroider all embroidery areas. In addition, the present apparatus 1 does not require a user to select one of different stitching manners for each embroidery area, in contrast to the previously-explained second prior apparatus. Since the present apparatus 1 selects a stitching manner suitable for the shape of each embroidery area, the embroidery data produced by the apparatus 1 ensures that an excellent embroidery is formed in conformance with the shape of the embroidery area.

In addition, the present apparatus 1 determines the two sorts of parameters K, K' as the roundness degree of each embroidery region, and selects a stitching manner suitable for the embroidery region, based on both the two parameters K, K'. Even if the measured area S and/or outline length L of each embroidery region may contain a quantization error because of dealing with the picture elements of an original image, the present apparatus 1 reliably selects a stitching manner highly suitable for the embroidery region, by using the two parameters K, K'. Furthermore, the present apparatus 1 employs, for each parameter K, K', changed threshold values for small and large embroidery regions, respectively. Thus, in the present embodiment, a stitching manner is selected for each embroidery region by a highly sophisticated technique.

While the present invention has been described in its preferred embodiment, the present invention may otherwise be embodied.

For example, although in the illustrated embodiment the two parameters K and K' are used as the roundness index of each embroidery area, it is possible to use only one of the two parameters K, K'.

It goes without saying that the present apparatus 1 can operate for selecting a stitching manner suitable for an original image consisting of a single outline-bounded area, i.e., a single embroidery area.

Furthermore, while in the illustrated embodiment three stitching manners, i.e, satin, seed and zigzag stitching are employed, it is possible to employ one or more different stitching manners, such as running stitching, in place of, or in addition to, those stitching manners.

In the illustrated embodiment, the color image scanner 12 may be replaced by a black-and-white image scanner to obtain black-and-white image data from an achromatic color image. In this case, the apparatus 1 may be programmed to divide the color image into, e.g., black, gray, and white areas by utilizing the differences of brightness of the individual picture elements of the achromatic image.

The apparatus 1 of FIG. 1 may essentially be provided by using a widely used personal computer, and the image scanner 12 may be replaced by a different image pick-up device. In place of the image scanner 12 employed for obtaining image data representing an original image, it is possible to utilize a batch of image data pre-stored in an external memory such as a floppy disk or a flash-memory card. The batch of image data may be a set of outline data representing the outline or outlines of an embroidery region.

It is to be understood that the present invention may be embodied with other changes, improvements, and modifications that may occur to those skilled in the art without departing from the spirit and scope of the invention defined in the pending claims.

What is claimed is:

1. An apparatus for processing embroidery data to control a sewing machine to form an embroidery on a work sheet, the apparatus comprising:

determining means for determining, based on outline data representing an outline of an embroidery region, an area of said embroidery region bounded by said outline thereof and a length of the outline of the embroidery region, and determining a degree of roundness of the embroidery region based on the determined area and length; and selecting means for selecting, based on the determined degree of roundness of said embroidery region, one of a plurality of different stitching manners in which said embroidery is to be formed in said embroidery region by the sewing machine according to said embroidery data.

2. An apparatus according to claim 1, further comprising producing means for producing said embroidery data based on said outline data and stitching-manner data representing said one stitching manner selected by said selecting means.

3. An apparatus according to claim 2, wherein said producing means comprises means for producing, as said embroidery data, at least one of (a) a number of sets of stitch-position data representing stitch positions on said outline of said embroidery region where a sewing needle of the sewing machine penetrates said work sheet and (b) a plurality of sets of block data each of which represents an outline of a corresponding one of a plurality of polygonal blocks which cooperate with each other to define said embroidery region.

4. An apparatus according to claim 2, wherein said producing means comprises means for producing said embroidery data comprising said outline data associated with said stitching-manner data.

5. An apparatus according to claim 1, wherein said determining means comprises means for determining, as said degree of roundness of said embroidery region, at least one of a first parameter, K, defined by a following first expression (1) and a second parameter, K', defined by a following second expression (2):

$$K=S/L^2 \quad (1)$$

$$K=S/L \quad (2)$$

where

S is said determined area of said embroidery region, and

L is said determined length of said outline of the embroidery region.

6. An apparatus according to claim 5, wherein said selecting means comprises means for selecting said one stitching manner from said plurality of different stitching manners, by comparing said at least one of said first and second parameters K, K' with at least one of a first reference value and a second reference value, respectively.

7. An apparatus according to claim 6, wherein said selecting means comprises means for selecting said one stitching manner from said plurality of different stitching manners comprising at least two stitching manners selected from the group consisting of a seed stitching, a satin stitching, and a zigzag stitching.

8. An apparatus according to claim 7, wherein said selecting means comprises means for comparing said first parameter K with said first reference value and selecting said seed stitching when said first parameter K is greater than said first reference value.

9. An apparatus according to claim 7, wherein said selecting means comprises means for comparing said first and second parameters K with said first and second reference values, respectively, and selecting said satin stitching when said first parameter K is not greater than said first reference value and said second parameter K' is greater than said second reference value.

10. An apparatus according to claim 7, wherein said selecting means comprises means for comparing said second parameter K' with said second reference value and selecting said zigzag stitching when said second parameter K' is not greater than said second reference value.

11. An apparatus according to claim 1, wherein said selecting means comprises means for comparing said degree of roundness of said embroidery region with a reference value, and selecting a first one of said different stitching manners when the degree of roundness of the embroidery region is greater than said reference value and selecting a second one of said different stitching manners when the degree of roundness of the embroidery region is not greater than said reference value, said first and second stitching manners being different from each other.

12. An apparatus according to claim 11, wherein said selecting means comprises means for changing said reference value, based on at least one of said determined area and outline length of said embroidery region.

13. An apparatus according to claim 1, further comprising an image pick-up device which picks up, as said embroidery region, an original image from an original, and produces said outline data comprising image data representing said original image.

14. An apparatus according to claim 13, wherein said image pick-up device comprises means for producing, as said image data, a number of sets of picture-element data each set of which represents a corresponding one of a number of picture elements of said original image, said determining means determining said area of said embroidery region based on the sets of picture-element data representing the picture elements contained in said original image as said embroidery region, and determining said length of said outline of the embroidery region based on the sets of picture-element data representing the picture elements defining an outline of the original image as the embroidery region.

15. An apparatus according to claim 13, wherein said image pick-up device comprises:

separating means for separating said original image comprising a plurality of outline-bounded regions each of which is bounded by at least one outline thereof, into said outline-bounded regions each as said embroidery region; and outline-data producing means for producing, as said outline data, a plurality of sets of outline data each set of which represents an outline of a corresponding one of said outline-bounded regions.

16. An apparatus according to claim 2, further comprising a utilizing device which utilizes said embroidery data produced by said producing means to control the sewing machine to form said embroidery on said work sheet in said one stitching manner selected by said selecting means.

17. An apparatus according to claim 16, wherein said utilizing device comprises a stitch-forming device of the sewing machine which forms stitches in said embroidery region according to said embroidery data and thereby produces said embroidery on said work Sheet.

18. An apparatus according to claim 16, wherein said utilizing device comprises a recording device which records, in an external memory, said embroidery data to control the sewing machine to form said embroidery on said work sheet.

19. An apparatus according to claim 18, wherein said recording device records said embroidery data in a flash-memory card as said external memory.

20. A method of processing embroidery data to control a sewing machine to form an embroidery on a work sheet, the process comprising the steps of:

determining, based on outline data representing an outline of an embroidery region, an area of said embroidery region bounded by said outline thereof and a length of the outline of the embroidery region, and determining a degree of roundness of the embroidery region based on the determined area and length, and selecting, based on the determined degree of roundness of said embroidery region, one of a plurality of different stitching manners in which said embroidery is to be formed in said embroidery region by the sewing machine according to said embroidery data.

21. A process according to claim 20, further comprising a step of producing said embroidery data based on said outline data and stitching-manner data representing the selected one of said stitching manners.

22. A process according to claim 21, further comprising a step of utilizing the produced embroidery data to control the sewing machine to form said embroidery on said work sheet in said selected one stitching manner.

23. A process according to claim 22, wherein said step of utilizing said produced embroidery data comprises forming stitches in said embroidery region according to said embroidery data and thereby producing said embroidery on said work sheet.

24. A process according to claim 22, wherein said step of utilizing said produced embroidery data comprises recording said embroidery data in an external memory such as a flash-memory card.

* * * * *